US005494229A

United States Patent [19]

Rokos et al.

[11] Patent Number: 5,494,229

[45] Date of Patent: Feb. 27, 1996

[54] PAPER SHREDDER WITH AN IMPROVED LUBRICATION SYSTEM AND METHOD OF LUBRICATING

[75] Inventors: George A. Rokos, Naperville; Jim C. Sander, Arlington Heights; John C. Peklo, Elmhurst, all of Ill.

[73] Assignee: Cummins-Allison Corp., Mt. Prospect, Ill.

[21] Appl. No.: 292,871

[22] Filed: Aug. 19, 1994

[51] Int. Cl.[6] ..... B02C 18/06; B02C 23/18; B02C 25/00

[52] U.S. Cl. ..... 241/15; 241/25; 241/33; 241/66; 241/101.2; 241/236; 184/6.1

[58] Field of Search ..... 83/169; 184/6.1; 241/33, 66, 101.2, 167, 236, 15, 25, 30

[56] References Cited

U.S. PATENT DOCUMENTS 4,757,949 7/1988 Horton ..... 241/236 X
5,163,629 11/1992 Raterman et al. .
5,186,398 2/1993 Vigneaux, Jr. .
5,285,973 2/1994 Goforth ..... 241/236 X

OTHER PUBLICATIONS

Security Engineered Machinery operating and installation instructions on Automatic Shredder Oiler, SEM Model LK system, undated.

*Primary Examiner*—Timothy V. Eley
*Attorney, Agent, or Firm*—Arnold, White & Durkee

[57] ABSTRACT

This invention is directed to a shredding machine utilizing a lubrication process to increase the shredding capacity and service life of the machine. More specifically, the invention discloses a distribution manifold containing a plurality of uniformly dispersed pores which discharge fluid across the cutting elements of the shredding machine in a precise and even manner. The pore diameter and length can be chosen to provide for variable fluid discharge rates. Additionally, this invention relates to a lubrication discharge system which utilizes an actuating means that controls the discharge intervals over which the porous manifold releases the fluid. Provisions are included which allow for the lubrication discharge system to operate by use of a pump, or by the mere force of gravity in combination with a control valve.

27 Claims, 10 Drawing Sheets

PAPER SHREDDER WITH AN IMPROVED LUBRICATION SYSTEM AND METHOD OF LUBRICATING

BACKGROUND OF THE INVENTION

1. Field of the Invention

This invention relates generally to shredding machines, and more particularly to a lubrication distribution system within the shredding machine which provides a lubricating fluid to the cutting elements while they shred sheet materials.

2. Description of the Background Art

Most paper shredders employ a pair of counter-rotating rollers having a plurality of interleaved cutting elements. As shreddable material, such as paper, is fed between the counter-rotating rollers, the interleaved curing elements cut or tear the material into longitudinal strips using a scissor-like action. In many applications, such as governmental document destruction, this type of destruction proves inadequate because of the possibility that the content of the shredded documents can be reconstructed since characters remain on the longitudinal strips. Therefore, improved shredders have been developed which shred materials in both the longitudinal and lateral directions.

Although both types of shredders mentioned destroy documents satisfactorily, there are limitations to the rate at which material can be shredded. The "metal-to-metal" contact required to cut strips into segments causes a significant amount of wear on the cutting elements and rollers which reduces the shredding rate. More importantly, the repeated contact between the cutting elements and the shreddable material causes stress and heating on the curing surfaces of the curing elements. Over time, this continuous stress and thermal cycling at the cutting surfaces results in the dulling of the cutting elements which leads to shredder performance degradation. In addition to the reduction in shredding rate, the maintenance costs are increased and the overall service life of the shredding machine is reduced. Experimentation has shown that lubricating the cutting elements reduces the coefficient of friction between the moving parts and diminishes the thermal cycle to which the cutting surfaces are subjected due to the cooling effects of the lubrication fluid. The ultimate result of the lubrication process is a higher shredding capacity and an increased service life of the shredding machine.

In many mechanical systems employing cutting elements, it is typical to supply lubrication to those elements to reduce friction and resist the tendency to dull. However, this lubrication concept has not been widely utilized in shredding machines. U.S. Pat. No. 5,186,398 discloses a method and apparatus for lubricating the cutting elements of a shredding machine. First, the shafts mounting the cutting elements come to a complete stop which suspends the shredding process. Then, the shafts rotate in the reverse direction as oil from a pipe with discrete holes drips onto the cutting elements. After a predetermined period, the oil flow ceases and the shafts commence rotation in the forward shredding mode. Although this method of lubrication fulfills the need for lubrication, it creates an undesirable "down-time" in the shredder thereby diminishing the shredder system efficiency. Additionally, the pipe must be precisely manufactured such that the discharge holes evenly distribute the lubrication across the cutting elements.

In the unpatented "Automated Shredder Oiler" by Security Engineered Machinery of Massachusetts, the lubrication system is designed for retrofitting non- lubricated shredding machines. The AC electric cord of the shredding machine is plugged into the retrofit lubrication system which, in turn, is plugged into the electrical socket. As long as current is drawn by the shredder, the pump operates at a user-defined duty cycle and forces oil to a cloth-wrapped manifold while the shredding process is effectuated. The cloth is used to provide a more even distribution of the lubricating oil than a plain manifold with discrete holes. However, the cloth tends to become "baggy" at undetermined regions of the manifold upon saturation with oil causing oil accumulation in those baggy regions. Ultimately, the oil flow onto the cutting elements below those baggy regions is dramatically increased in comparison to other regions which is adverse to the desired result of an even distribution of oil. Additionally, the pump utilized is an automobile fuel pump which draws approximately 4 Amps which limits the current that can be allocated to the shredding machine. Furthermore, since the current draw of each type of shredding machine is unique, it is possible that the summation of the pump current and the shredder current will exceed the current capabilities of the source.

SUMMARY OF THE INVENTION

Briefly, the present invention is directed to a new and improved lubrication distribution manifold as well as a lubrication discharge system for shredding machines. The lubrication distribution manifold provides precise and even emission of lubrication fluid across all cutting elements. Additionally, the lubrication discharge system selectively discharges the lubrication fluid at controlled intervals while shredding is in progress such that no "down-time" is encountered. More particularly, this invention provides for the incorporation of the above-mentioned lubrication distribution manifold into the lubrication discharge system.

The lubrication distribution manifold is made from a rigid material having small pores. The manifold has an internal cavity where the lubrication fluid is contained, and is positioned such that it is capable of supplying the fluid to at least one of the shafts carrying the cutting elements. Due to the uniform population of pores within the manifold, the manifold precisely and evenly distributes fluid across all cutting elements on the shaft. The hydraulic diameter and length of the pores determine the discharge time interval over which the fluid is discharged when subjected to a predetermined back pressure. Optimally, this back pressure is low so that a small, low-power pump can be utilized. Alternatively, the hydraulic diameter and the pore length can be chosen such that mere gravity is enough to pull the fluid through the pores and slowly discharge it onto the cutting elements.

Regarding the overall lubrication discharge system provided by this invention, a pump which supplies the fluid to a discharge manifold is selectively controlled by an actuating means without interrupting the shredding process. This actuating means is typically a microprocessor which sends a command to energize or deenergize the pump. The pump is typically a low-current, DC pump which runs off the existing DC power source within the shredding machine that is needed for other shredding machine functions. In the most basic embodiment, a timing mechanism, possibly in the form of software programmed into the microprocessor, causes the actuation of the pump at controlled time intervals. Alternatively, the microprocessor monitors a shaft rotational sensor and actuates the pump at controlled angular displacement intervals. Thus, the pumping frequency can vary simply by modifying the microprocessor software.

In yet another alternative, the microprocessor monitors a signal from a torque sensor disposed on the shaft. This situationally-related signals result in lubrication of the curing elements only at times when the shredding machine is subject to heavy shredding loads thereby conserving lubrication fluid and increasing efficiency. This alternative is useful in shredding machines which are subjected to both high shredding loads and low shredding loads as is typical in most office environments.

In one embodiment, the lubrication discharge system employs the above-described porous distribution manifold in combination with the microprocessor which actuates the pump at intervals defined by a timing mechanism or external dam. The pump is only actuated for short intervals, usually on the order of one second, to supply fluid to the manifold cavity and provide enough back pressure to discharge the fluid over a discharge time interval until the next actuation of the pump occurs. Thus, the desired goal of precise, even, and efficient distribution of a lubrication fluid across the cutting elements without interrupting the shredding process is achieved.

In a second embodiment, the lubrication discharge system uses the force of gravity to supply the porous manifold with the fluid from the reservoir. Instead of the actuating means energizing a pump to supply the fluid, the actuating means controls a valve thereby regulating the flow of fluid into the manifold. The hydraulic diameter and length of the pores are chosen such that only gravity is needed to pull the fluid through the pores since no pump is utilized. Any of the mechanisms defining the actuation intervals described above can be employed to effectuate the same result as the previous embodiment which incorporates a pump. Without compromising precise and even fluid distribution, this embodiment even furthers the object of efficiency since no pump work is required.

BRIEF DESCRIPTION OF THE DRAWINGS

Other objects and advantages of the invention will become apparent upon reading the following detailed description and upon reference to the drawings in which.

Figure 1A:
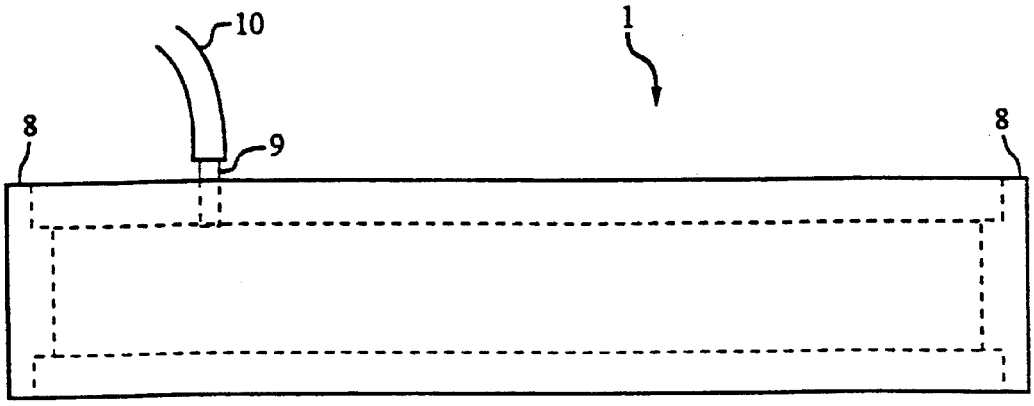
FIG. 1*a* is a plan view of a porous discharge manifold with an axis-centric cavity.

While the invention is susceptible to various modifications and alternative forms, specific embodiments thereof have been shown by way of example in the drawings and will be described in detail. However, it should be understood there is no intention to limit this invention to the particular forms disclosed. On the contrary, this intention is to cover all modifications, equivalents, and alternatives falling within the spirit and scope of the invention as defined by the appended claims.

DESCRIPTION OF THE PREFERRED EMBODIMENTS

Figure 1B:
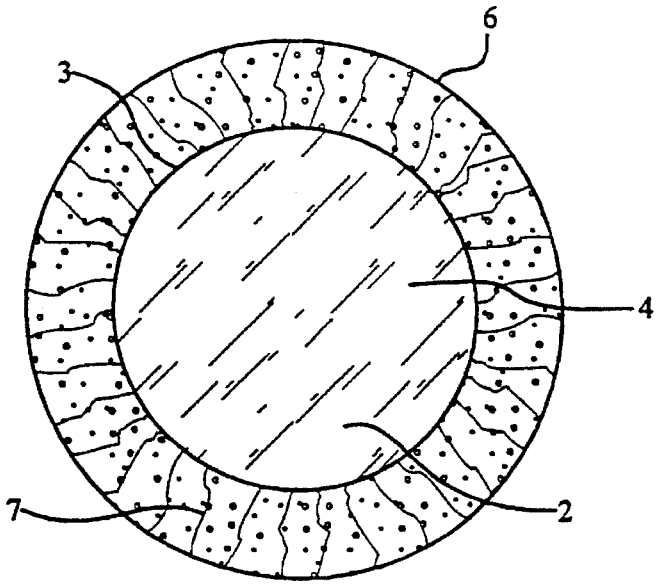
FIG. 1*b* is an end view of the manifold in FIG. 1*a* with the end cap removed.

Referring initially to FIGS. 1*a* and 1*b*, a porous manifold 1 for supplying a lubrication fluid 2 to the cutting elements of a shredding machine is shown in a plan view as well as in an end view. The manifold 1 includes an internal surface 3 which defines a cavity 4 that encloses the lubrication fluid 2. FIG. 1*b* illustrates the cavity 4 as filled with the lubrication fluid 2. The inner surface 3 is connected to an outer surface 6 by a plurality of pores 7 which are shown only in the end view. Each end of the cylindrically shaped manifold 1 has an end cap 8 which restrains the fluid 2 from flowing axially from the cavity 4. A fitting 9 which extends through the wall of the manifold 1 and intersects the inner surface 3 protrudes radially from the outer surface 6 and attaches to interconnect tubing 10. Although the fitting 9 is shown at the circumference of the manifold 1, it could alternatively be placed at one end of the manifold 1 where one of the end caps 8 is shown. Additionally, the manifold 1 could be box-shaped with only the porous material on the surface facing the shaft of the cutting elements such that the manifold 1 would fit around the shaft.

The porous manifold 1 is made of a material containing pores which permit oil to pass from the interior to the exterior of the manifold, through the manifold walls. A preferred material is porous polyethylene containing pores which are uniformly distributed throughout the material, with an average hydraulic diameter of 20 microns and an average length of 0.125 inch (the preferred manifold wall thickness). One such material is made by Porex Technologies Inc. of Fairburn, Georgia. The preferred pore size for any given application is somewhat dependent on the viscosity of the oil that is used.

Figure 1C:
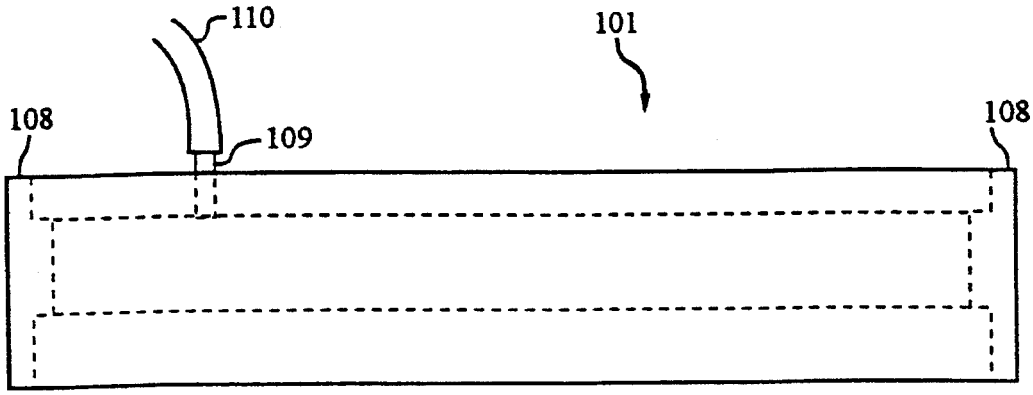
FIG. 1*c* is a plan view of a porous discharge manifold with an eccentric cavity.
Figure 1D:
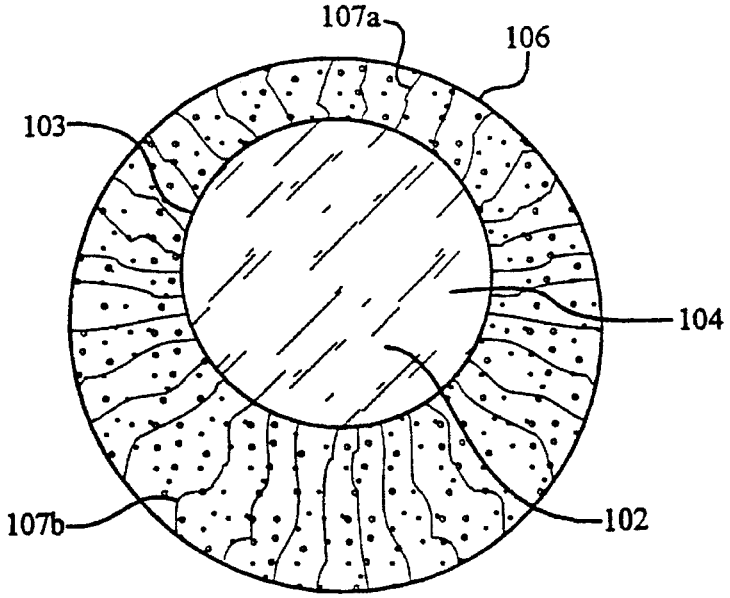
FIG. 1*d* is an end view of the manifold in FIG. 1*c* with the end cap removed.

FIGS. 1*c* and 1*d* are similar to FIGS. 1*a* and 1*b* except the elements are referenced as a 100 series for simplicity. However, an internal surface 103 defining a cavity 104 is eccentric with respect to an outer surface 106. Thus, pore length is a function of its angular orientation. The benefit derived from such a design is that a porous manifold 101 filled with a lubrication fluid 102 discharges the fluid 102 at different rates depending on the angular orientation of the manifold 101 when only gravity is needed to discharge the fluid 102. Put simply, if the gravitational gradient is parallel to pore 107*a*, the manifold 101 discharges the fluid 102 at outer surface 106 very quickly in comparison to manifold 101 oriented such that the gravitational gradient is parallel to pore 107*b*. Porous manifold 101 provides for a simplistic adjustment to the time required to completely discharge a given volume of fluid 102 from the manifold 101 by merely rotating the manifold 101 with respect to the gravitational gradient.

Figure 2:
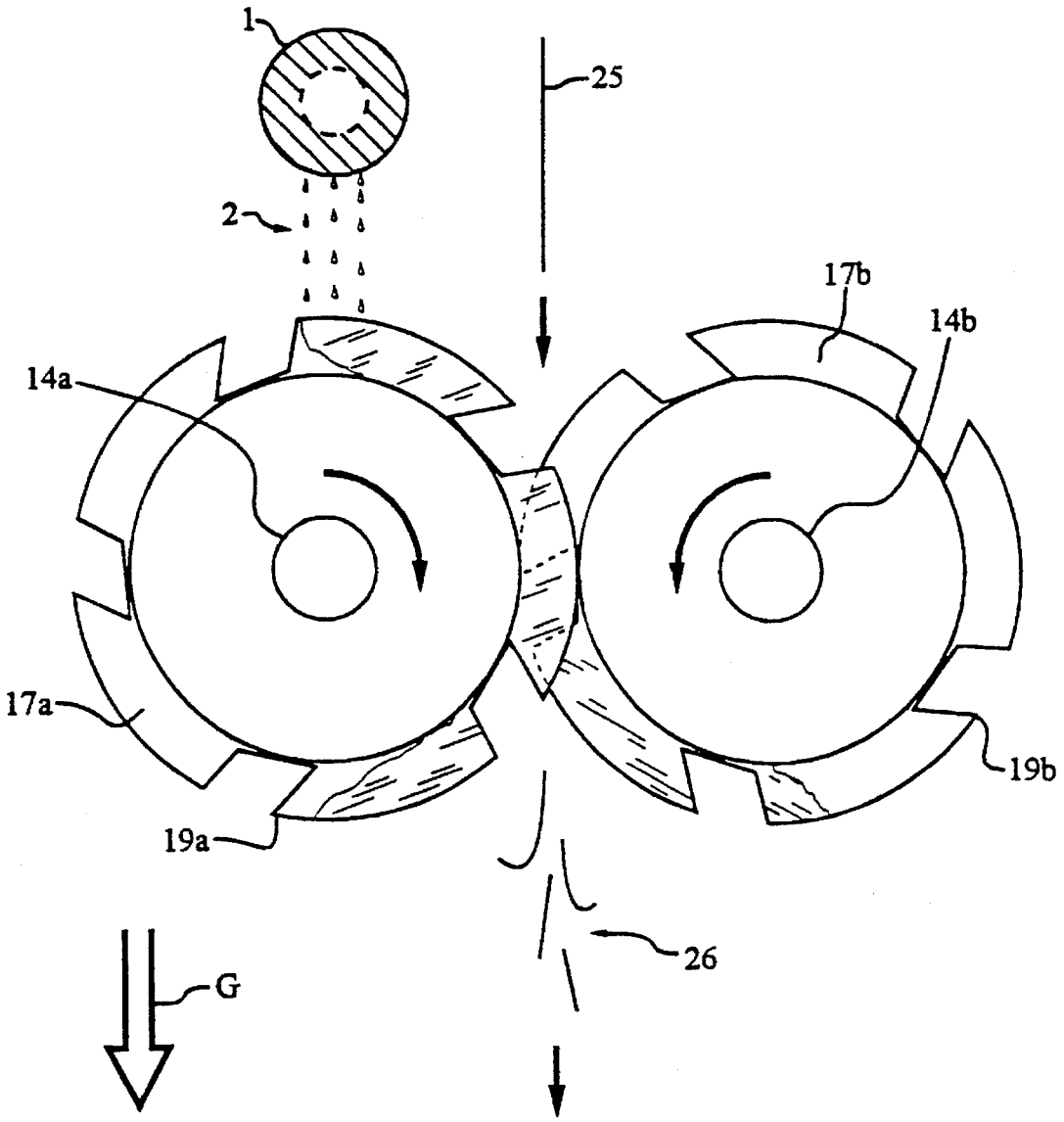
FIG. 2 is a side plan view illustrating a typical relationship of the porous fluid distribution device to the cutting elements of the shredding machine.
Figure 3:
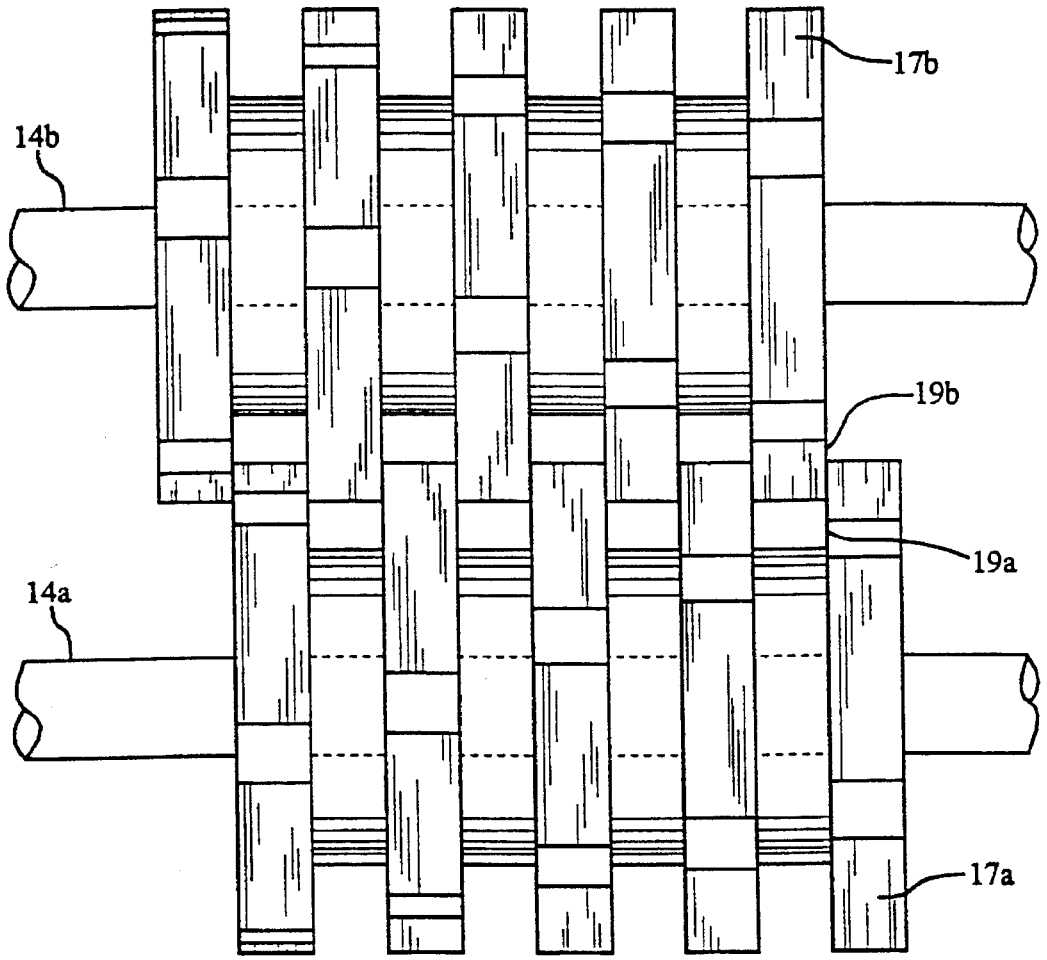
FIG. 3 is a top plan view of the interleaving cutting elements within a typical shredding machine.

FIG. 2 shows one possible configuration wherein the manifold 1 is placed above only one of the shafts 14*a* and 14*b* mounting the cutting elements 17*a* and 17*b*. The relationship of these cutting elements 17*a* and 17*b* is shown in a top view in FIG. 3. The fluid 2 falls from the pores 7 in the direction parallel to the gravitational gradient G. As shown by the stippled region on the upper fight of cutting dement 17*a*, the fluid 2 travels to the engagement region and is dispersed upon the lower left of cutting element 17*b*. As the shafts 14*a* and 14*b* continue rotation, the entire cutting surfaces 19*a* and 19*b* are covered with the fluid 2. In typical operational, shreddable material 25 enters the engagement area between the two counter-rotating shafts 14*a* and 14*b* and is shredded by the cutting elements 17*a* and 17*b* resulting in shredded material 26. Alternatively, a porous manifold 1 is placed above each shaft 14*a* and 14*b*. In a further alternative, one lubrication pan is placed over the cutting elements 17*a* and 17*b* with the porous material only in those regions directly above cutting elements 17*a* and 17*b*.

Figure 4:
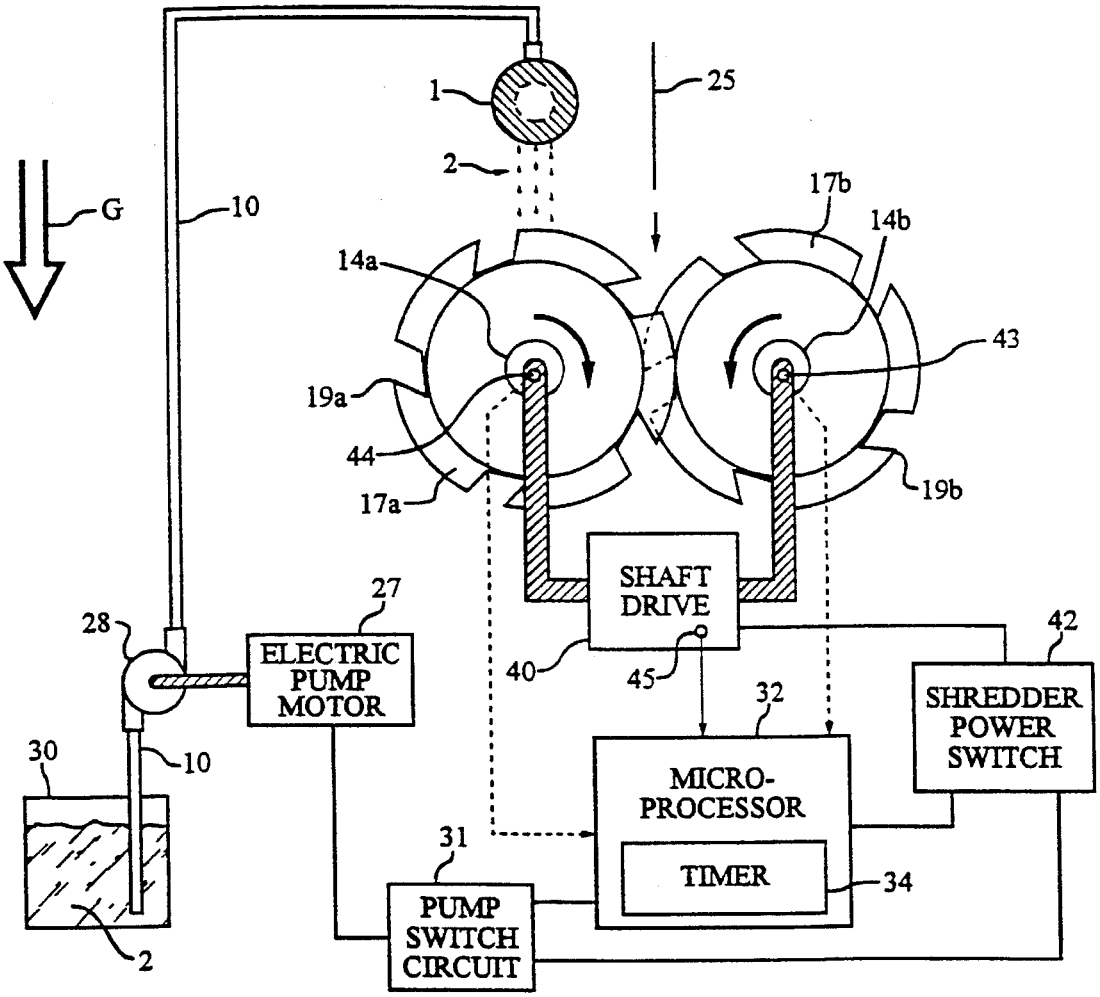
FIG. 4 is a general mechanical and electrical schematic of the pertinent elements of the lubrication discharge system using a electrically driven pump.

FIG. 4 shows one preferred embodiment of the lubrication distribution system provided by this invention in which an electric pump motor 27 drives a pump 28 thereby supplying fluid 2 from a reservoir 30 to the manifold 1. A preferred pump is a 12-volt DC diaphragm pump which produces a pressure of about 7 psi within the manifold. Like FIG. 2, the manifold 1 is positioned above shaft 14*a* to directly lubricate cutting elements 17*a* and indirectly lubricate cutting element 17*b*. Power is supplied to a pump switch circuit 31, a microprocessor 32, and a shaft drive 40 upon activation of a shredder power switch 42. The microprocessor 32 uses an internal timing mechanism 34 to determine when the lubrication fluid 2 should be supplied to the manifold 1 only while receiving a positive signal from a shaft motor current sensor 45. The microprocessor 32, which also contains internal memory, subsequently sends a positive signal to the pump switch circuit 31 which drives the electric pump motor 27. The electric pump motor 27 then actuates the pump 28 and fluid 2 is forced from a reservoir 30 to the manifold 1 through the interconnect tubing 10. The reservoir 30 can simply be the container in which the lubrication fluid 2 is shipped and stored. The pressure of the pump 28 slowly forces the fluid 2 through the pores 7 thereby distributing fluid 2 onto the cutting elements 17 as the shaft drive 40 rotates the shafts 14 while the shreddable material 25 continues to be shredded.

In a preferred system, the pump 28 is turned on for a half second every 37 seconds while the shredder is running. Most of the oil supplied to the manifold drains onto the cutting elements within about 30 seconds after the pump is turned off. Thus, oil is actually supplied to the cutting elements during at least 80% of the time that the cutting elements are rotating.

In an alternative arrangement, the hydraulic diameter and the length of the pores 7 are chosen such that gravity G alone can pull the fluid 2 from the manifold 1. In this case, the pump 28 is only used for carrying the fluid 2 to the manifold 1.

FIG. 4 shows the microprocessor 32 including the internal timing mechanism 34 which determines when the pump 28 should be actuated. Alternatively, the actuating controller 32 can receive signals from a shaft rotational sensor 43 or a torque sensor 44 disposed on either shaft 14. Both of these alternatives are shown connected to the microprocessor 32 in dashed lines in FIG. 4.

Figure 5:
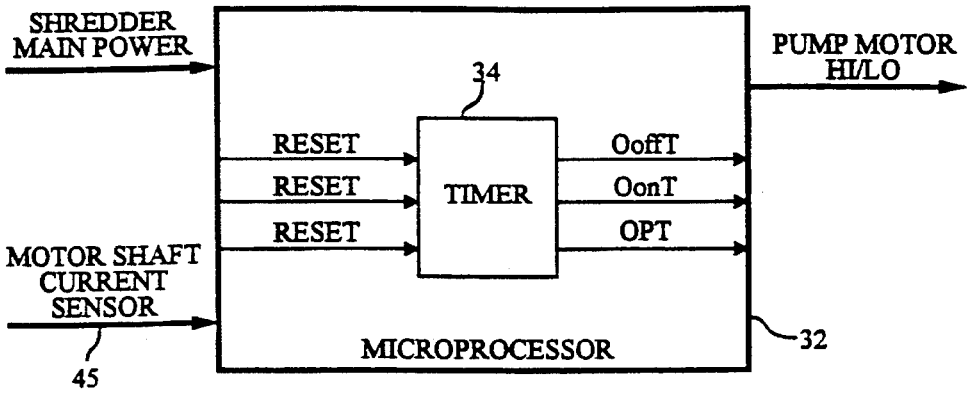
FIG. 5 is a block diagram of a microprocessor-based controller using an internal timing mechanism to define the pump energizing intervals.
Figure 6:
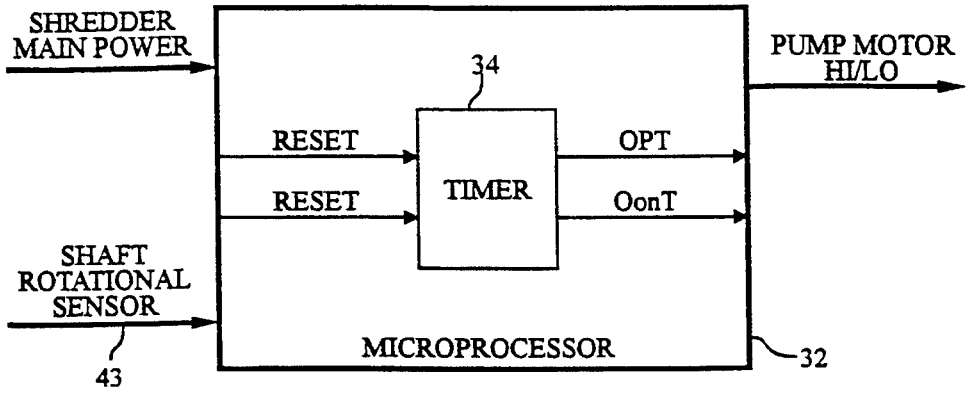
FIG. 6 is a block diagram of a microprocessor-based controller using a shaft rotation counter to define the pump energizing intervals.
Figure 7:
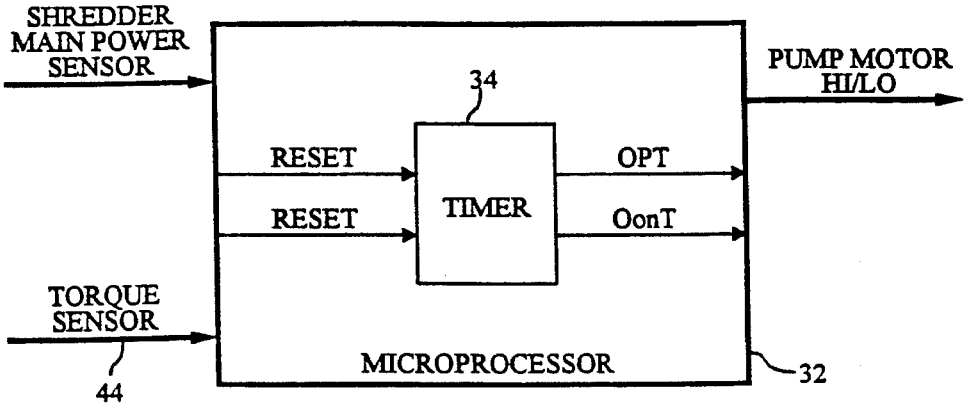
FIG. 7 is a block diagram of a microprocessor-based controller using a torque sensor to define the pump energizing intervals.
Figure 8:
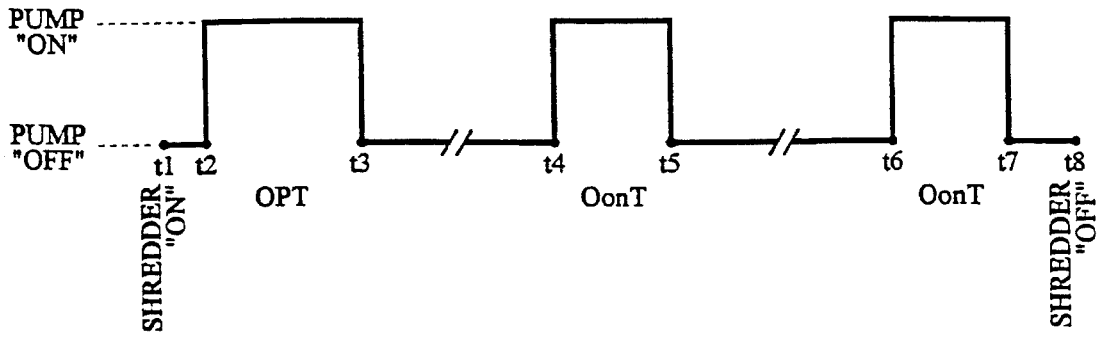
FIG. 8 is a generic timing diagram depicting the on/off cycles of the pump.
Figure 9:
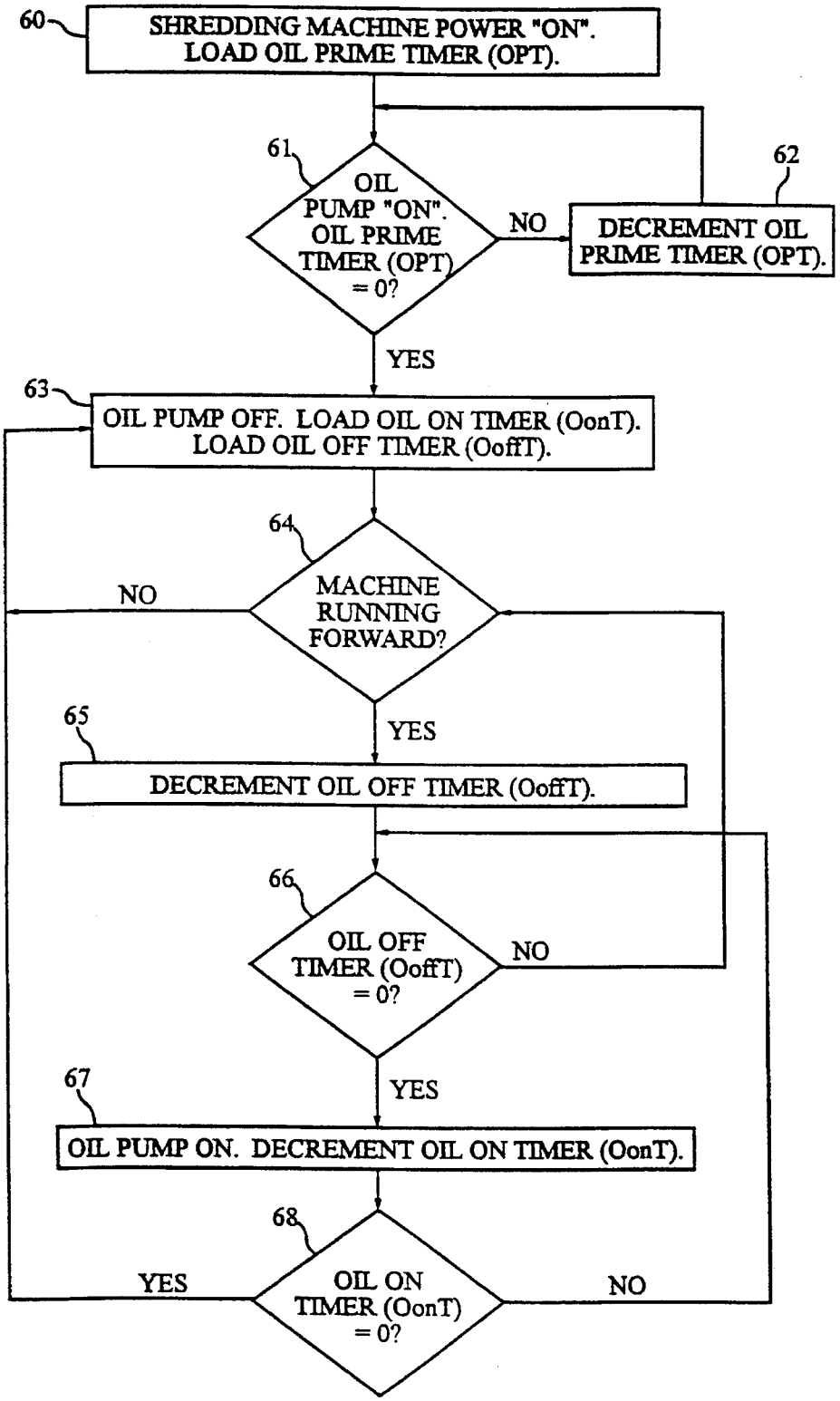
FIG. 9 is a flow chart illustrating the sequence of operations used to actuate the pump at predetermined time intervals.

FIGS. 5, 6 and 7 show the inputs and outputs of the microprocessor 32 when the internal timing mechanism 34, the shaft rotational sensor 43, and the torque sensor 44 are respectively used. FIG. 8 illustrates a typical "on/off" cycle that the electrical pump motor 27 experiences thereby controlling the pump 28. FIG. 9 shows the sequence of operations when the timing mechanism 34 is used to actuate the pump 28.

FIG. 5 illustrates the internal timing mechanism 34 providing the time intervals Oil Prime Timer ("OPT", Oil On Timer ("OonT"), and Oil Off Timer ("OoffT"). In the most simplistic approach to the timing mechanism 34, software is programmed into the memory of the microprocessor 32 and used to define these time intervals. Knowing that each command within the microprocessor 32 takes a finite length of time, a software loop can be developed which corresponds to the predetermined time interval.

After the shredder power is turned "on", the microprocessor loads the OPT segment of the timing software as shown in step 60 in FIG. 9. This is represented by time t1 in FIG. 8. The pump 28 is then actuated and OPT is checked to ensure that its value is greater than 0 as shown by step 61 in FIG. 9. This is represented by time t2 in FIG. 8. Any delay between time t1 and t2 is a function of the speed of the processing circuitry and thus should be quite small. If the answer to step 61 is negative, OPT is decremented as shown in step 62. When the answer to step 61 is positive (OPT equals 0), the pump 28 is deactivated and the initial fluid priming of the cutting elements 17 is complete as shown by step 63. The microprocessor 32 then loads OonT and OoffT as also shown by step 63. This corresponds to time t3 in FIG. 8. The shredding machine is now ready for shredding. Any future lubrication will occur only when the cutting elements 17 are engaged in the shredding process.

Once shreddable material 25 is introduced to the machine and the shaft drive 40 is activated, the microprocessor 32 receives a signal from a shaft motor current sensor 45 indicating that the machine is running forward as illustrated by step 64 in FIG. 9. If the answer to step 64 is negative, then the sequence returns to step 63 wherein the value of OoffT is reset. Alternatively, the software could hold the previous value of OoffT and begin future decrementation from that previous value. If the answer to step 64 is positive, then OoffT is decremented one value as shown by step 65 in FIG. 9. Step 66 then checks to ensure that OoffT is not equal to 0. If the answer to step 66 is negative, then the procedure returns to step 64 to ensure the machine is running forward before OoffT is decremented any further. If the answer to step 66 is positive, then the pump 28 is actuated and OonT is decremented by one value as shown in step 67. This is shown as time 14 in FIG. 8. Next, step 68 checks if OonT has reached 0. If the answer to step 68 is negative, the sequence returns to step 66 as the pump continues to operate. If the answer to step 68 is positive, the sequence returns to step 63 and the pump 28 is deenergized as represented by time t5 in FIG. 8. Typically, OonT has values of less than 1 second thereby limiting any problem of disengagement of the cutting elements 17 while OonT is greater than 0. At step 63, OoffT and OonT are again reloaded and this cyclical process continues until the shredder power switch 42 is turned "off" as illustrated by time t8 in FIG. 8.

FIG. 6 illustrates a block diagram of a microprocessor 32 using a shaft rotational sensor 43 as the signal for determining when to actuate the pump 28. In such a design, the shaft rotational sensor 43 sends a discrete counting signal to the microprocessor 32 each time the shaft 14 rotates. Internal counting software within the microprocessor 32 increments one value for each counting signal received. Once the internal counting software reaches a predetermined value, a positive signal is sent from the microprocessor 32 to the pump switch circuit 31 thereby actuating the electric pump motor 27. As opposed to the system in FIG. 5 which uses strictly a timing mechanism 34, there is no need for a shaft motor current sensor 45 since the shaft 14 must be rotating when the counting signal which triggers the pump 28 actuation is received. Additionally, the microprocessor 32 preferably has a start-up mode wherein lubrication occurs after the first revolution of the shaft 14 over a timed interval similar to OPT in FIG. 5. Also, internal timing software dictates the time interval of the positive signal from the microprocessor 32 to the pump switch circuit 31 like OonT used in FIG. 5.

With reference again to FIG. 8 as applied to the shaft rotational sensor 43 of FIG. 6, time t1 refers to the time when the shredder power switch 42 is turned-on. Time t2 represents the first rotation of the shaft 14, thereby loading the OPT software segment and triggering the initial lubrication of the cutting elements 17. From time t2 to t3, the microprocessor 32 decrements OPT until it reaches 0 at t3 wherein the positive signal to the pump switch circuit 31 is deactivated. At time t3, the counting software is reset to 0 and the initial priming of the system is complete. Each time the shredder shaft 14 rotates, the counting software increments one value until time t4 where the predetermined counting value is reached and OonT is reloaded. From time t4 to t5, OonT is decremented and the microprocessor 32 sends a positive signal to the pump switch circuit 31 which activates the electric pump motor 27. When OonT reaches 0 at time t5, the positive signal to the pump switch circuit 31 is deactivated and the counting software is reset to 0 for future incrimination as the shaft 14 rotates. This cyclical process continues until the shredder power switch 42 is turned off at time t8.

FIG. 7 is a block diagram of a microprocessor 32 which monitors a torque sensor 44 located on the shaft 14 (FIG. 4). Under normal shredding conditions, the torque on the shaft 14 is a nominal value during rotation. However, when a high capacity of paper is input, the torque on the shaft 14 is increased. If the torque sensor 44 sends a signal to the microprocessor 32 which exceeds a predetermined value, the microprocessor 32 sends a signal to the pump switch circuit 31 (FIG. 4) which activates the electric pump motor 27 for a predetermined time interval, OonT, and fluid 2 is provided to the cutting elements 17. Thus, the lubrication process reduces friction and decreases the torque on the shaft 14. Additionally, the microprocessor 32 preferably has a start-up mode wherein internal timing software dictates the time interval for the positive signal for initial priming, like variable OPT as used in FIG. 5.

With reference again to FIG. 8 as applied to torque sensor 44 of FIG. 5, time t1 is when the shredder power switch 42 is turned-on. Time 12 represents the loading of the OPT software segment which triggers the initial lubrication of the cutting elements 17. From time t2 to t3, the microprocessor 32 decrements OPT until it reaches 0 at t3 wherein the positive signal to the pump switch circuit 31 is deactivated. At time t3, the initial priming of the system is complete and the microprocessor 32 continues to monitor the torque sensor 44 (FIG. 4). As the shredder shaft 14 rotates, the microprocessor 32 receives a torque signal less than the predetermined value until time t4 where the predetermined torque value is exceeded and OonT is reloaded. From time t4 to t5, OonT is decremented as the microprocessor 32 sends a positive signal to the pump switch circuit 31 which activates the electric pump motor 27 (FIG. 4). When OonT reaches 0 at t5, the positive signal to the pump switch circuit 31 is deactivated and the microprocessor 32 begins to monitor the torque sensor 44 on the shaft 14. At any time, if the predetermined torque value is exceeded, the positive signal from the microprocessor 32 to the pump switch circuit 31 is activated. This cyclical process continues until the shredder power switch 42 is turned off at 18.

Alternatively, the torque sensor 44 could be replaced by a temperature sensor located near the cutting surfaces 19 or a torsion sensor disposed on the shaft 14. Both of these alternative sensors operate under the same algorithm of the torque sensor 44 wherein the microprocessor 32 activates the pump 28 once it monitors an input signal from these sensors that exceeds a predetermined value. In a further alternative, a device which senses the amount of the material entering the cutting elements 17, such as an optical scanner or a weight measuring device, initiates the actuation of the pump 28.

In yet another alternative, the torque sensor 44 signalling method is combined with the internal timer or counter methodology. In this embodiment, the torque sensor 44 provides an override signal that automatically actuates the pump 28 under heavy loads. Otherwise, the periodic lubrication from the counter or timer methodology is employed.

Besides the microprocessor 32, other means exist which could perform the same function as the microprocessor 32. Conventional electronics including relays could easily provide the required sequencing of the pump actuation.

In one alternative to the electrical pump 28, the pump 28 is mechanically powered by the shaft drive 40. An engagement box is added to provide for the mechanical connection between the shaft drive 40 and the pump 28. Thus, the need for an electric pump motor 27 no longer exists in this alternative embodiment. The same type of signals (timer, counter, torque sensor, etc.) are monitored by the microprocessor 32 and a positive signal from the microprocessor 32 to the pump switch circuit 31 causes the mechanical engagement of the shaft drive 40 to the pump 28. The engagement box likely includes a plurality of gears or belts, at least one of which is adjustable and moves into an engagement position upon receipt of a positive signal from the pump switch circuit 31.

Figure 10:
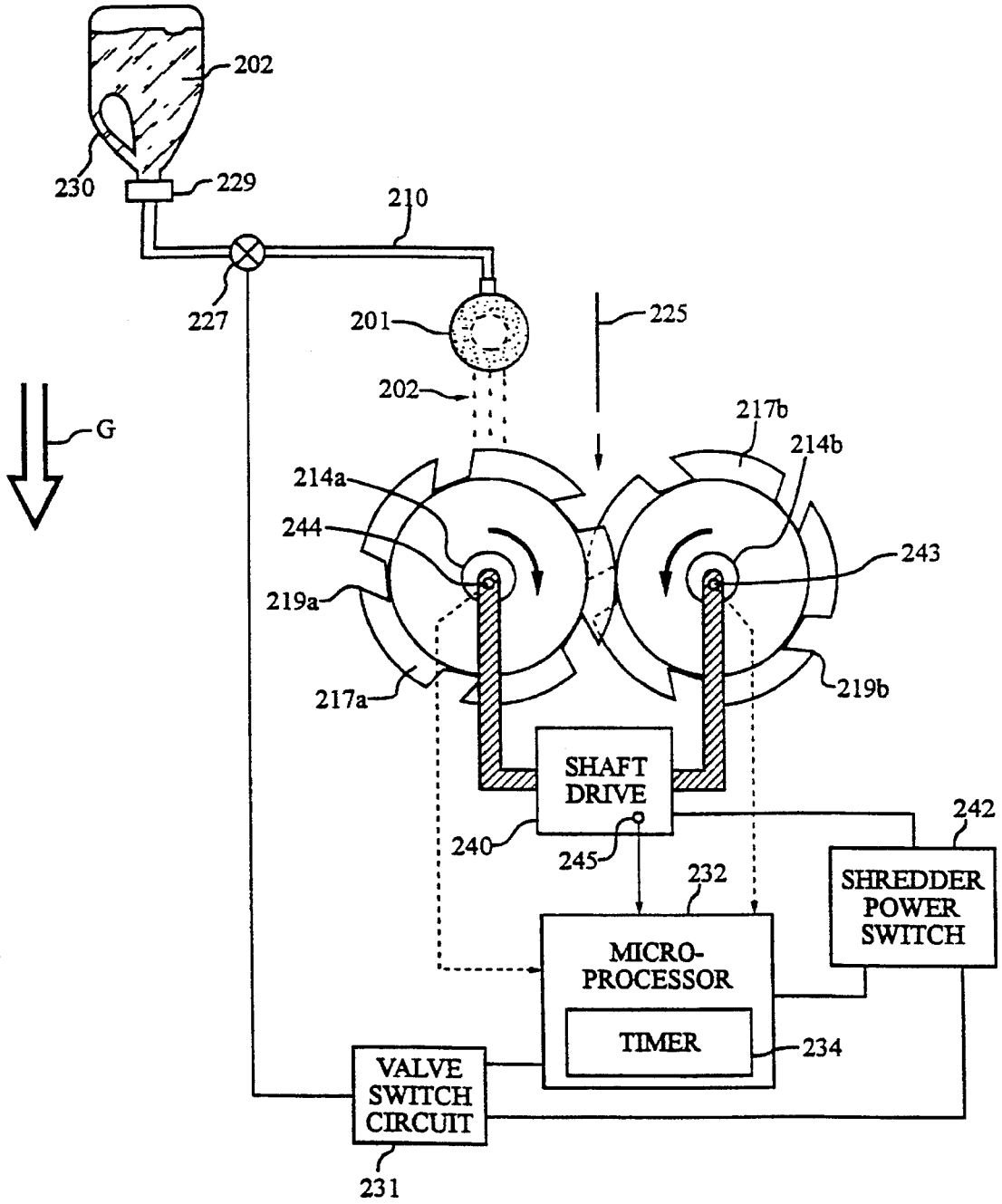
FIG. 10 is a general electrical and mechanical schematic for a lubrication distribution system that uses gravity to supply the fluid to the manifold.

In FIG. 10, the basic shredding machine structure and lubrication control system are analogous to the components of FIG. 4 except that they are now referenced as a 200 series to avoid confusion. FIG. 10 illustrates a lubrication distribution system which relies upon gravity G to convey a lubrication fluid 202 into a manifold 201 through interconnect tubing 210 connected to a reservoir 230. An electrically switched control valve 227 is disposed within the tubing 210 which permits or prohibits flow of the fluid 202 into the manifold 201. The reservoir 230 is fitted with a special cap 229 that includes means for direct attachment to the interconnect tubing 210.

The same type of microprocessor-based control system used in the lubrication distribution system employing a pump 28 in FIG. 4 can be used in this system. The main difference is that when a microprocessor 232 determines that the lubrication process is needed through a timing mechanism 234, a rotational sensor 243, or a torque sensor 244, the microprocessor 232 sends a positive signal to the valve switch circuit 231 which opens the control valve 227 for a predetermined interval of time. The time interval is sufficiently long to completely fill the porous manifold 201 when the reservoir 230 is nearly empty and has little back pressure to force the fluid 202 into the porous manifold 201. If it is determined that the length of the time interval is too long such that when the reservoir 230 is full, the large back pressure forces fluid 202 out of the pores 207 after the manifold 201 is filled but before the control valve 227 closes, then a pressure sensor can be placed in the cap 229 which the microprocessor 232 would monitor. The microprocessor 232 then adjusts the time interval over which the control valve 227 remains open based on the pressure at the cap 229 thereby providing the exact amount of fluid 202 into the manifold 201 under all conditions. This pressure sensor could serve a dual role in that the microprocessor 232 could send a signal to a user interface panel indicating when the fluid reservoir 230 is low or empty.

Figure 11:
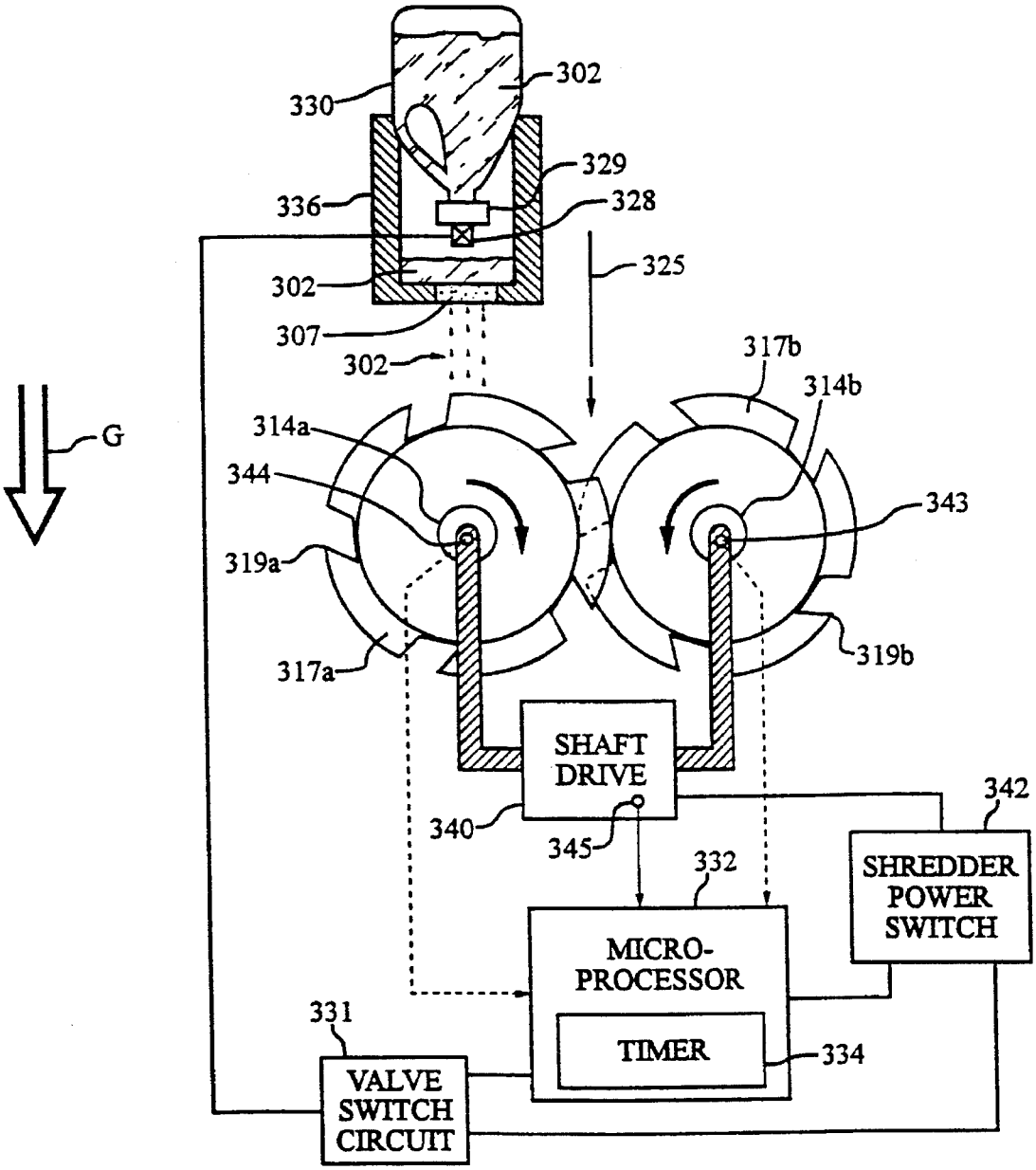
FIG. 11 is a system similar to FIG. 10 except the fluid reservoir is integrated into a porous manifold distribution structure.

In yet another alternative embodiment, FIG. 11 illustrates a system similar to that shown in FIG. 10 wherein gravity G provides the force needed to convey fluid 302 from a reservoir 330. Again, the basic shredding machine structure and lubrication control system are analogous to the components of FIG. 10 except that they are now referenced as a 300 series to avoid confusion. The primary difference between this embodiment and that of FIG. 10 is that this embodiment utilizes a discharge channel 336 in which the reservoir 330 is structurally integrated. In this alternative, the reservoir 330 could simply be the container in which the lubrication fluid is shipped and stored. The discharge channel 336 has a length which sufficiently covers all of the cutting elements 317*a* on shaft 314*a*. Additionally, the discharge channel 336 has pores 307 within its bottom structure such that when fluid 302 is placed within the discharge channel 336, it is slowly discharged onto the cutting elements 317*a* under the force of gravity G.

The same type of microprocessor-based control system described above for the embodiment shown in FIG. 10 is used in this system. A cap 329 incorporates a control valve 328 which controls the flow of fluid 302 onto the pores 307 of the discharge channel 336. The microprocessor 332 sends a positive signal to the valve switch circuit 331 which opens the control valve 328.

In an alternative embodiment, the discharge channel 336 is placed over both shafts 314*a* and 314*b* for direct lubrication of both sets of cutting elements 317*a* and 317*b*. In yet another alternative, the discharge channel 336 has an intermediate horizontal structural plane which acts as a reservoir by holding the fluid 302. The intermediate structural plane contains a control valve 328, like the one shown within the cap 329 in FIG. 11, which controls the flow of fluid 302 from the intermediate structural plane onto the pores 307 at the bottom of the discharge channel 336. This embodiment has the advantage of conforming the discharge channel 336, likely made of plastic, around all other structure making maximum use of the shredding machine space. Additionally, the fluid 302 is simply added to the shredder after opening a lid structure at the top of the discharge channel 336 exposing the intermediate structural plane on which the fluid 302 is poured.

We claim:

1. A method of lubricating a shredding machine having at least two axially parallel shafts carrying cutting elements, at axially-spaced intervals and a shaft drive means providing for counter-rotation of said shafts in a shredding mode, the method comprising the steps of:

supplying a lubrication fluid to a manifold disposed above and axially parallel to at least one of said shafts, said manifold including an internal surface defining a cavity and an external surface exposed to said cutting elements, said manifold having pores distributed in an axial direction along said manifold and connecting said internal surface to said external surface; and discharging said lubrication fluid through said pores onto said cutting elements while said cutting elements are engaged in said shredding mode.

2. The method of claim 1 wherein said step of discharging said fluid includes the step of pressurizing said manifold.

3. The method of claim 1 wherein said pores have a length and a hydraulic diameter permitting said fluid to be discharged under the standard gravitational force, and said step of discharging said fluid utilizes said standard gravitational force.

4. In a shredding machine having at least two axially parallel shafts carrying cutting elements at axially-spaced intervals and a shaft drive means providing for counter-rotation of said shafts in a shredding mode, said shafts positioned such that said cutting elements of one shaft interleave with said cutting elements of said other shaft, an automated lubrication system comprising, a manifold disposed above and axially parallel to at least one of said shafts including an internal surface defining a cavity and an external surface exposed to said cutting elements, wherein said manifold is comprised of a material containing pores which connect said internal surface to said external surface, said pores being uniformly distributed throughout said manifold;

a reservoir for storage of a lubrication fluid;

means for supplying said fluid from said reservoir to said manifold; and means for selectively actuating said fluid supply means to discharge said fluid from said manifold while said cutting elements are engaged in said shredding mode.

5. An automated lubrication system as defined in claim 4 wherein said actuating means includes processing circuitry, memory devices, and means for monitoring signals.

6. An automated lubrication system as defined in claim 5 wherein said actuating means further includes a timing mechanism to produce time signals and said monitoring means monitors said time signals, said time signals determining when said supply means is actuated.

7. An automated lubrication system as defined in claim 6 wherein said actuating means includes a shaft drive means monitoring device for producing a shaft drive means signal and actuation of said supply means occurs only when said shaft drive means signal is positive.

8. An automated lubrication system as defined in claim 4 wherein said manifold is porous polyethylene.

9. An automated lubrication system as defined in claim 8 wherein said fluid is discharged from said manifold during at least 80% of said shredding mode.

10. An automated lubrication system as defined in claim 5 wherein said actuating means includes a shaft rotation counting device for producing a counting signal and said monitoring means monitors said counting signals, said counting signals determining when said supply means is actuated.

11. An automated lubrication system as defined in claim 5 wherein said actuating means includes a shaft torque sensor for producing a torque signal and said monitoring means monitors said torque signal, said torque signals determining when said supply means is actuated.

12. An automated lubrication system as defined in claim 5 wherein said supply means includes an electrically driven pump.

13. An automated lubrication system as defined in claim 12 wherein said pump is a diaphragm pump.

14. An automated lubrication system as defined in claim 4 wherein said manifold is pressurized.

15. An automated lubrication system as defined in claim 5 wherein said supply means includes a mechanically driven pump, said pump being driven by said shaft drive means.

16. An automated lubrication system as defined in claim 4 wherein said fluid is discharged from manifold through said pores when subjected to the standard gravitational force.

17. In a shredding machine having at least two axially parallel shafts carrying cutting elements at axially spaced intervals and a shaft drive means providing for counter-rotation of said shafts in a shredding mode, said shafts positioned such that said cutting elements of one shaft interleave with said cutting elements of said other shaft, an automated lubrication system comprising, a manifold disposed above and axially parallel to at least one of said shafts including an internal surface defining a cavity and an external surface exposed to said cutting elements, wherein said manifold is comprised of a material containing pores which connect said internal surface to said external surface, said pores being uniformly distributed throughout said manifold and having a length and a hydraulic diameter which determine a discharge time interval over which said cavity filled with a lubrication fluid discharges said fluid onto said cutting elements when subjected to the standard gravitational force, a reservoir for storage of said fluid disposed above said manifold including supply tubing connecting said reservoir to said manifold wherein gravity pulls said fluid from said reservoir into said manifold, a control valve disposed within said tubing to regulate the flow of said fluid from said reservoir into said manifold, and means for selectively actuating said control valve to initiate the discharge of said fluid from said manifold while said cutting elements are engaged in said shredding mode.

18. In a shredding machine having at least two axially parallel shafts carrying cutting elements at axially spaced intervals and a shaft drive means providing for counter-rotation of said shafts in a shredding mode, said shafts positioned such that said cutting elements of one shaft interleave with said cutting elements of said other shaft, an automated lubrication system comprising, a manifold disposed above and axially parallel to at least one of said shafts including an internal surface defining a cavity and an external surface exposed to said cutting elements, wherein said manifold is comprised of a material containing pores which connect said internal surface to said external surface, said pores being uniformly distributed throughout said manifold and having a length and a hydraulic diameter which determine a discharge time interval over which said cavity filled with a lubrication fluid discharges said fluid onto said cutting elements when subjected to the standard gravitational force, a reservoir for storage of said fluid disposed above and integral with said manifold wherein gravity pulls said fluid from said reservoir into said manifold, a control valve disposed within said reservoir to regulate the flow of said fluid from said reservoir into said manifold, and means for selectively actuating said control valve to initiate the discharge of said fluid from said manifold while said cutting elements are engaged in said shredding mode.

19. In a shredding machine having at least two axially parallel shafts carrying cutting elements at axially spaced intervals and a shaft drive means providing for counter-rotation of said shafts in a shredding mode, said shafts positioned such that said cutting elements of one shaft interleave with said cutting elements of said other shaft, a lubricating device comprising, a manifold disposed above and axially parallel to at least one of said shafts including an internal surface defining a cavity and an external surface exposed to said cutting elements, wherein said manifold is comprised of a material containing pores which connect said internal surface to said external surface, said pores having a length and a hydraulic diameter which determine a discharge time interval over which said cavity filled with a lubrication fluid discharges said fluid onto said cutting elements under the standard gravitational gradient while said cutting elements are engaged in said shredding mode, and means for supplying said fluid to said manifold.

20. A lubricating device as defined in claim 19 wherein said supplying means includes an electrically driven pump which forces said fluid into said manifold.

21. A lubricating device as defined in claim 19 wherein said supplying means includes a mechanically driven pump which forces said fluid into said manifold.

22. A lubricating device as defined in claim 19 wherein said supplying means includes a reservoir for storing said fluid, said reservoir being disposed at a point having a higher gravitational potential energy than said manifold and gravity provides the force to convey said fluid into said manifold.

23. A lubricating device as defined in claim 19, wherein said internal and external surfaces of said manifold are cylindrical and said internal surface is eccentric to said external surface, said pores including long length pores and short length pores wherein said long length pores discharge said fluid at a slower rate than said short length pores under the same gravitational gradient and said manifold is rotationally adjustable about its axis to provide for an optimal discharge rate.

24. In a shredding machine having at least two axially parallel shafts carrying cutting elements at axially spaced intervals and a shaft drive means providing for counter-rotation of said shafts in a shredding mode, said shafts being positioned such that said cutting elements of one shaft interleave with said cutting elements of said other shaft, a lubricating device comprising, manifold disposed above and axially parallel to at least one of said shafts including an internal surface defining a cavity and an external surface exposed to said cutting elements, wherein said manifold is comprised of a material containing pores which connect said internal surface to said external surface, said pores having a length and a hydraulic diameter which inhibit flow of a lubrication fluid therethrough when said cavity is filled with said fluid and subjected to the standard gravitational force, means for supplying said fluid to said manifold, and means for discharging fluid from said manifold through said pores while said cutting elements are engaged in said shredding mode.

25. A lubricating device as defined in claim 24 wherein said supplying means includes an electrically driven pump, and wherein said pump also provides said discharge means.

26. A lubricating device as defined in claim 24 wherein said supplying means includes a mechanically driven pump, and wherein said pump also provides said discharge means.

27. A lubricating device as defined in claim 24 wherein said manifold material is porous polyethylene.

* * * * *